US006101351A

United States Patent [19]

Suda et al.

[11] Patent Number: 6,101,351

[45] Date of Patent: Aug. 8, 2000

[54] IMAGE FORMING APPARATUS HAVING A SHUTTER MECHANISM FOR PROTECTING AN IMAGE BEARING MEMBER

[75] Inventors: Takeo Suda, Katsushika-ku; Hiroshi Yoshinaga, Ichikawa, both of Japan

[73] Assignee: Ricoh Company, Ltd., Tokyo, Japan

[21] Appl. No.: 09/276,469

[22] Filed: Mar. 25, 1999

[30] Foreign Application Priority Data

Mar. 25, 1998 [JP] Japan ..... 10-096717
Nov. 6, 1998 [JP] Japan ..... 10-331986

[51] Int. Cl.[7] ..... G03G 21/18

[52] U.S. Cl. ..... 399/114; 399/125

[58] Field of Search ..... 399/114, 24, 25, 399/26, 111, 112, 113, 124, 125

[56] References Cited

U.S. PATENT DOCUMENTS

| | | | |
|---|---|---|---|
| 5,113,220 | 5/1992 | Kwak | 399/114 |
| 5,231,453 | 7/1993 | Nakai et al. | 399/114 |
| 5,266,999 | 11/1993 | Yashiro | 399/114 |
| 5,678,125 | 10/1997 | Kutsuwada et al. | 399/26 |
| 5,815,767 | 9/1998 | Kutsuwada et al. | 399/25 |

FOREIGN PATENT DOCUMENTS

| | | |
|---|---|---|
| 62-75657 | 4/1987 | Japan . |
| 2-140760 | 5/1990 | Japan . |
| 5-346694 | 12/1993 | Japan . |
| 06186795 | 7/1994 | Japan . |
| 06186798 | 7/1994 | Japan . |

*Primary Examiner*—Susan S. Y. Lee
*Assistant Examiner*—Hoan Tran
*Attorney, Agent, or Firm*—Oblon, Spivak, McClelland, Maier & Neustadt, P.C.

[57] ABSTRACT

An image forming apparatus includes an image bearing member to form a toner image thereupon. A transfer device is positioned adjacent to the image bearing member to transfer the toner image formed on a surface of the image bearing member onto a surface of a recording medium. A cleaning device cleans the surface of the image bearing member by removing remaining toner on the surface of the image bearing member after the toner image has been transferred onto the recording medium. A fixing device is provided in an upper part of the image forming apparatus to fix the toner image transferred onto the surface of the recording medium when the recording medium passes through the fixing device. An open/close member is rotatably supported by a main body of the image forming apparatus and opens and closes a recording medium conveying path between the transfer device and the fixing device. And, a shutter is movably supported to move between a protecting position to cover a part of the surface of the image bearing member facing the outside of the image forming apparatus when the open/close member is opened and a retreating position to open the part of the surface of the image bearing member when the open/close member is closed. The retreating position of the shutter is set in a space between the image bearing member and the fixing device and the shutter is movably supported by the main body of the image forming apparatus such that the shutter moves with a first face of the shutter continuously facing the image bearing member when the shutter moves between the protecting position and the retreating position.

16 Claims, 7 Drawing Sheets

*BACDKGROUND ART*

IMAGE FORMING APPARATUS HAVING A SHUTTER MECHANISM FOR PROTECTING AN IMAGE BEARING MEMBER

BACKGROUND OF THE INVENTION

1. Field of the Invention

The present invention relates to an image forming apparatus having an open/close member rotatably supported by a main body of the image forming apparatus to open and close a recording medium conveying path between a transfer device and a fixing device, and more particularly relates to an image forming apparatus having the open/close member provided with a shutter mechanism to cover a surface of the image bearing member when the open/close member is opened.

2. Discussion of the Background

Typically, an image forming apparatus, such as a copying machine, a facsimile, a printer, a multi-functional machine including at least two functions of the above-mentioned products, etc. includes an image bearing member to form a toner image thereupon. Also, a transfer device is positioned adjacent to the image bearing member to transfer the toner image formed on a surface of the image bearing member onto a surface of a recording medium and from a lower part of the image forming apparatus. A cleaning device cleans the surface of the image bearing member by removing remaining toner from the surface of the image bearing member after the toner image has been transferred therefrom onto the recording medium. And, a fixing device is provided in an upper part of the image forming apparatus to fix the toner image transferred from the surface of the image bearing member onto the surface of the recording medium when the recording medium passes through the fixing device.

The image forming apparatus further includes an open/close member rotatably supported by a main body of the image forming apparatus to open and close a recording medium conveying path between the transfer device and the fixing device for removing a recording medium jammed in the recording medium conveying path. A shutter mechanism is provided to protect the surface of the image bearing member which is exposed to the outside of the main body of the image forming apparatus when the open/close member is opened.

FIG. 1 is a schematic cross-sectional view illustrating an example of an image forming apparatus having the above-described configuration. The image forming apparatus has an advantage such that the size of the apparatus can be made relatively compact because a recording medium is conveyed through an approximately straight conveying path from a lower part to an upper part of the image forming apparatus, as illustrated in FIG. 1, and thereby the entire recording medium conveying path can be made relatively short. A time period for a recording medium to be conveyed through the entire conveying path can therefore be shortened.

Further, a recording medium jammed in the recording medium conveying path between the transfer device and the fixing device can easily be removed because the recording medium conveying path between the transfer device and the fixing device is exposed to the outside of the main body of the image forming apparatus by opening the open/close member as noted above.

In the above-described image forming apparatus of FIG. 1, when the open/close member is opened, the part of the surface of the image bearing member facing the open/close member is exposed to the outside of the image forming apparatus and receives light from the outside of the image forming apparatus. As a result, when the open/close member remains open for a long time, the image bearing member may be deteriorated by receiving the external light.

In addition, when the open/close member is opened by a user to remove a recording medium which is jammed in the recording medium conveying path between the transfer device and the fixing device, if the exposed part of the surface of the image bearing member is touched by the user's hand or comes into contact with the jammed recording medium, the surface of the image bearing member may be soiled or damaged. If an image is formed on a thus soiled or damaged surface of the image bearing member, the quality of the image will be deteriorated.

Japanese Laid-Open Patent Publication No. 6-186798 describes an example of an image forming apparatus having a shutter to protect the surface of the image bearing member that is exposed when the open/close member is opened.

FIG. 6 is a partial cross-sectional view illustrating a closed state of the open/close member in a background image forming apparatus rotatably supported by a main body of the apparatus to open and close a recording medium conveying path between the transfer device and the fixing device, in which a shutter to cover the surface of the image bearing member is opened. Further, FIG. 7 is a partial cross-sectional view illustrating an open state of the open/close member in the image forming apparatus of FIG. 6.

The shutter 132 is rotatably supported on a pair of pivots 131 and the shutter 132 rotates centered around a pair of pivots 131 in a direction indicated by a partial circle of a dot-and-a-dash line TA, as illustrated in FIG. 6. When the open/close member 23 is opened, the shutter 132 moves to a protecting position to cover the image bearing member and a transfer device 11 is separated from the image bearing member, as illustrated in FIG. 7. When the open/close member 23 is closed, the shutter 132 retreats to a retreating position and the transfer device 11 returns to the position facing the image bearing member such that a toner image on the surface of the image bearing member is transferred onto the surface of a recording medium Pa by a transfer device 11, as illustrated in FIG. 6.

The above-described shutter 132 of the background art requires a relatively large space for the rotation movement thereof, and therefore the image forming apparatus becomes relatively large. If the main body of the image forming apparatus provided with the above-mentioned shutter 132 is formed in a relatively compact size, the devices which are arranged near the image bearing member, such as, for example, the transfer device 11 and the fixing device 14, must be disposed in a relatively narrow space near the shutter 132 and, as a result, the devices may interfere with the shutter 132 when the shutter 132 is rotated. Accordingly, a flexibility for disposing the devices around the shutter 132 may be decreased.

Furthermore, when the open/close member 23 is opened to remove the recording medium Pa jammed in the recording medium conveying path between the transfer device 11 and the fixing device 14, and the shutter 132 then rotates from the retreating position to the protecting position to cover the image bearing member, the jammed recording medium Pa may be sandwiched between the rotating shutter 132 and the image bearing member as illustrated in FIG. 7. If the recording medium Pa is thus sandwiched, the user must remove the jammed recording medium Pa by opening the shutter 132 with the user's hand. As a result, a possibility for the user to touch the surface of the image bearing member with their hand increases, and a removing operation for the jammed recording medium Pa becomes more complex.

SUMMARY OF THE INVENTION

The present invention has been made in view of the above-discussed and other problems, and an object of the present invention is to address and resolve these and other problems.

According to a preferred embodiment of the present invention, a novel image forming apparatus includes an image bearing member to form a toner image thereupon. A transfer device is positioned adjacent to the image bearing member to transfer the toner image formed on a surface of the image bearing member onto a surface of a recording medium, which is conveyed from a lower part of the image forming apparatus. A cleaning device cleans the surface of the image bearing member by removing toner remaining on the surface of the image bearing member after the toner image has been transferred onto the recording medium. A fixing device is provided in an upper part of the image forming apparatus to fix the toner image transferred onto the surface of the recording medium when the recording medium passes through the fixing device.

An open/close member is rotatably supported by a main body of the image forming apparatus to open and close a recording medium conveying path between the transfer device and the fixing device. A shutter is movably supported to move between a protecting position to cover a part of the surface of the image bearing member facing the outside of the image forming apparatus when the open/close member is opened and a retreating position to open the part of the surface of the image bearing member when the open/close member is closed. The retreating position of the shutter is set in a space between the image bearing member and the fixing device and the shutter is movably supported by the main body of the image forming apparatus such that the shutter moves with a first face of the shutter continuously facing the image bearing member when the shutter moves between the protecting position and the retreating position.

Further, in the novel image forming apparatus the fixing device may be supported on the side of the main body of the image forming apparatus.

The novel image forming apparatus may further include a fan provided in the main body of the image forming apparatus to discharge air inside the main body outwards from the main body. The fixing device may be configured to fix the toner image transferred onto the recording medium by application of heat upon the toner image, and in which case a position of the fan may be set so that an airflow generated by the fan passes the shutter at the retreating position.

The cleaning device may be disposed at an upper part of the image forming apparatus relative to the image bearing member, and the retreating position of the shutter can be set so that, when the shutter is in the retreating position, the shutter can be located in a space between the cleaning device and the fixing device and the face of the shutter that faces the image bearing member when the shutter is in the protecting position may be positioned facing an upper surface of the cleaning device.

When the shutter is in the retreating position, the shutter may be positioned separated from the upper surface of the cleaning device so that the airflow passes through an air gap between the shutter and the cleaning device.

Further, in the novel image forming apparatus, first ends of a pair of arms may be respectively connected to the shutter at longitudinal ends thereof in a body and second ends of the pair of arms may be rotatably supported by the main body of the image forming apparatus, and when the shutter is in the retreating position, the first ends of the arms may be upwardly positioned above the upper surface of the cleaning device so that air flows through an air gap between the pair of arms.

BRIEF DESCRIPTION OF THE DRAWINGS

A more complete appreciation of the present invention and many of the attendant advantages thereof will be readily obtained as the same becomes better understood by reference to the following detailed description when considered in conjunction with the accompanying drawings, wherein.

DESCRIPTION OF THE PREFERRED EMBODIMENTS

Figure 1:
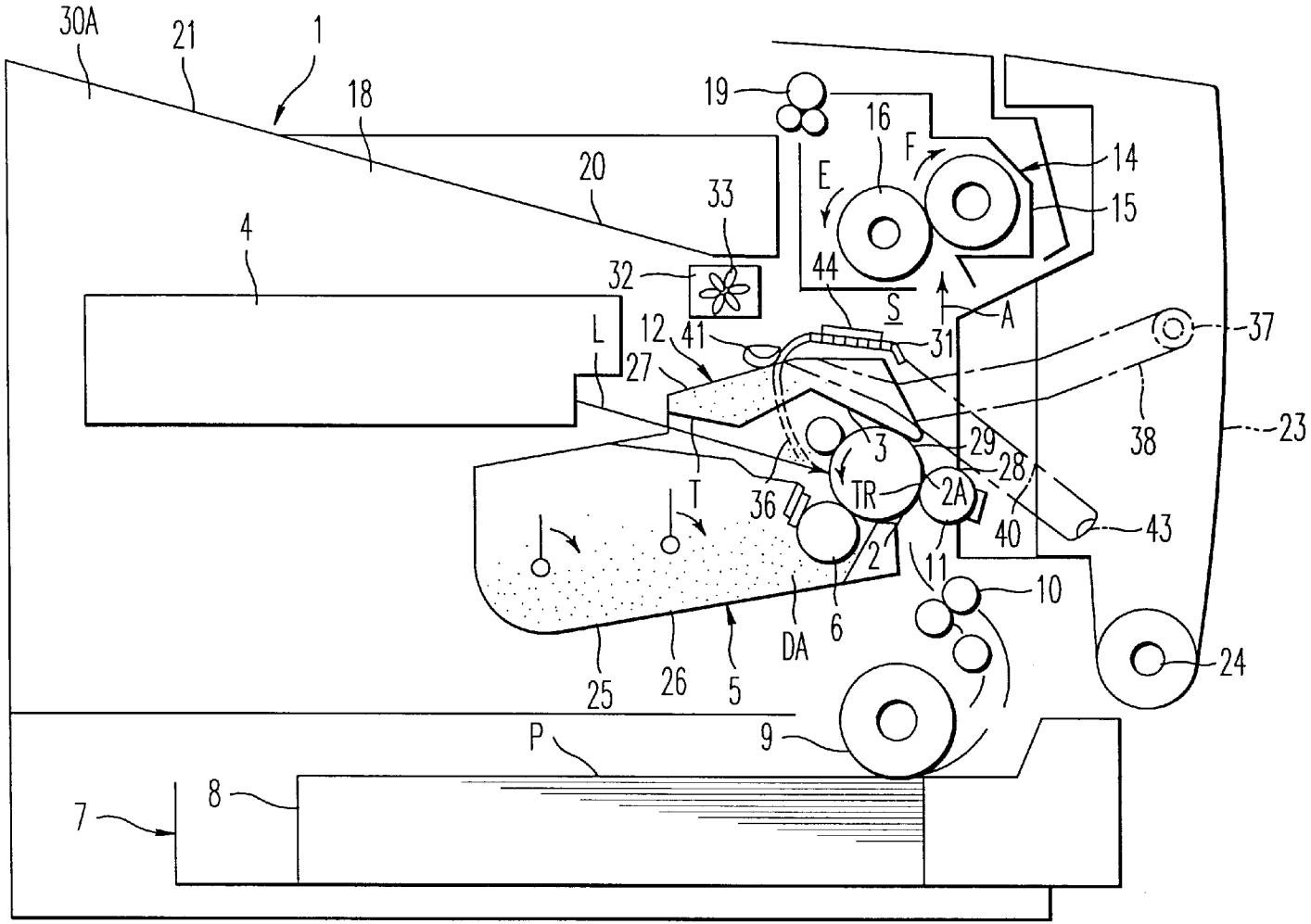
FIG. 1 is a schematic cross-sectional view illustrating an example of an image forming apparatus to which the present invention may be applied.

An embodiment of the present invention is described in detail referring to the drawings, wherein like reference numerals indicate identical or corresponding parts throughout the several views.

The image forming apparatus 1 illustrated in FIG. 1 is configured to be a laser printer, which is one example of an image forming apparatus to which the present invention may be applied. A drum-shaped photoconductive element 2 as an example of an image bearing member is located in the image forming apparatus 1. The photoconductive element 2 is rotated in a counterclockwise direction as illustrated in FIG. 1 when an image forming operation is performed. A surface of the photoconductive element 2 is given a uniform electric charge having a predetermined polarity by a charging roller 3 as an example of a charging device at a charging station. A voltage having a predetermined polarity is applied to the charging roller 3 by a power source (not shown) and the charging roller 3 comes into contact with the surface of the photoconductive element 2 rotating in the same rotating direction as that of the surface of the photoconductive element 2. As other examples, a charging blade or a corona charging device may also be used as the charging device instead of the charging roller 3.

An optically modulated laser light L emitted from a laser optical system 4 which is provided as an image exposure device is irradiated to the charged surface of the photoconductive element 2 at an exposure station thereof located at a position facing the photoconductive element 2. The above-described exposure by laser light L creates an electrostatic latent image on the surface of the photoconductive element 2.

The electrostatic latent image is then developed to a visible toner image through, e.g., use of a powder-like shaped developer mixture DA including a toner and a carrier conveyed by a developing roller 6 as a developer bearing member in a developing apparatus 5 at a developing station located at a position also facing the photoconductive element 2. The toner image is thus formed on the surface of the photoconductive element 2.

A sheet feeding device 7 is disposed at a lower part of a main body of the image forming apparatus 1, and a transfer sheet P as an example of a recording medium contained in a sheet feeding cassette 8 is individually fed therefrom by rotation of a sheet feeding roller 9. The fed transfer sheet P is upwardly conveyed to the transfer station TR, which is formed between a transfer roller 11 as an example of a transfer device and the photoconductive element 2, by registration rollers pair 10 at such a timing to register a leading edge of the transfer sheet P with the leading edge of the toner image formed on the surface of the photoconductive element 2.

When the transfer sheet P passes through the transfer station TR, the toner image formed on the photoconductive element 2 is transferred onto the surface of the transfer sheet P. The transfer roller 11 rotates contacting the photoconductive element 2 via the transfer sheet P and a voltage having a polarity opposite to that of the electric charge of the toner that forms the toner image on the photoconductive element 2 is applied to the transfer roller 11.

The toner image formed on the surface of the photoconductive element 2 is transferred onto a surface of the transfer sheet P by the aforementioned operation. A transfer blade, a transfer brush, a corona charger, or the like, may be employed for the transfer device. Thus, the transfer device transfers the toner image from the surface of the image bearing member made of the photoconductive element 2 onto the surface of the transfer sheet P which is conveyed from the sheet feeding device 7 at the transfer station TR.

Remaining toner T adhered on the surface of the photoconductive element 2 which is not transferred onto the transfer sheet P is removed by a cleaning member 13 of a cleaning device 12 which cleans the surface of the photoconductive element 2.

The transfer sheet P is separated from the photoconductive element 2 by discharge effect of a separation device including a discharging needle 28. The transfer sheet P that has passed through the transfer station TR is then conveyed upwardly as indicated by an arrow A in FIG. 1 and passes through a fixing device 14. The fixing device 14 illustrated in FIG. 1 includes a fixing case 15 that rotatably supports both of a fixing roller 16 and a pressure roller 17, and the fixing roller 16 has a built-in heater therein (not shown).

The fixing roller 16 and the pressure roller 17 rotate in a direction indicated by arrows E and F in FIG. 1, contacting each other with pressure, and the transfer sheet P passes therebetween. The fixing roller 16 is heated by the built-in heater and the toner image on the surface of the transfer sheet P is fixed thereto upon application of heat of the fixing roller 16 and a pressure between the fixing roller 16 and the pressure roller 17. Thus, the fixing device 14 is made of a heat fixing device that fixes the toner image transferred from the photoconductive element 2 onto the recording medium made of the transfer sheet P at least upon application of heat. The fixing device 14 provided with such a configuration is disposed at an upper part of the image forming apparatus 1 relative to the image bearing member 2. The transfer sheet P passed through the fixing device 14 is then discharged to a sheet discharge tray 20 with the surface carrying the image facing downward by rotating sheet discharge rollers pair 19. The image forming apparatus 1 includes an outer cover 21 and a main body frame 18, and the sheet discharge tray 20 is formed of an upper part of the outer cover 21.

In the image forming apparatus 1 as described above, the transfer sheet P is conveyed from a position lower than the photoconductive element 2 to the transfer station TR. The transfer sheet P that has passed through the transfer station TR is then conveyed to an upper position relative to the photoconductive element 2 and is discharged to the sheet discharge tray 20 after passing through the fixing device 14. A transfer sheet conveying method in which a transfer sheet is vertically conveyed from a lower part to an upper part of the apparatus as illustrated in FIG. 1 is referred to as a vertical conveying method. An entire conveying path for the transfer sheet P to be conveyed from the sheet feeding device 7 to the sheet discharge tray 20 can be shortened by adopting the vertical conveying method. Further, with this structure the image forming apparatus 1 can be configured in a compact size and an image forming time period for a first transfer sheet P at a continuous image forming operation can be reduced.

The photoconductive element 2, the charging roller 3, the developing apparatus 5, and the cleaning device 12 are integrated to form a unified image forming unit 22. The unified image forming unit 22 includes a unit case 25 to cover the image forming unit 22. A part of the unit case 25 serves as a part of a developer container 26 containing the developer mixture DA. The part of the developer container 26 serves as the largest part of the developing apparatus 5. A part of the unit case 25 also forms a part of the cleaning case 27. Remaining toner T removed from the surface of the photoconductive element 2 by the cleaning member 13 is contained therein. The image forming unit 22 is detachably attached to the main body of the image forming apparatus 1.

The image bearing member 2 is rotatably supported by the unit case 25 and is driven by a driving device (not shown).

In the above-described example as illustrated in FIG. 1, the image forming unit 22 includes image forming elements, such as the image bearing member 2, the charging roller 3, the developing apparatus 5, the cleaning device 12, and the unit case 25 for covering the image forming elements. However, as one variation, the image forming unit 22 can be configured by assembling the image bearing member 2 and at least one of the image forming elements. In the image forming unit 22 described above, a part of the photoconductive element 2 is exposed to the outside of the unit case 25 through an opening 29 formed at a part of the unit case 25 of the image forming unit 22 so as to face a transfer device, such as the transfer roller 11. As another variation, the photoconductive element 2 and another image forming element may be directly supported by the main body of the image forming apparatus 1 without forming the image forming unit 22.

Generally, a user (operator) operates the image forming apparatus 1 standing at the right side in FIG. 1 and the right side of the image forming apparatus 1 in FIG. 1 therefore denotes the front side of the image forming apparatus 1. At the right side of the image forming apparatus 1 in FIG. 1, an open/close member 23 is rotatably and swingably supported by the main body of the image forming apparatus 1 to open and close. The open/close member 23 is centered around a pair of pivots 24 which are positioned at a lower part of the main body of the image forming apparatus 1.

The open/close member 23 usually stays at a closed position covering the conveying path between the transfer station TR and the fixing device 14 in the image forming apparatus 1 as illustrated in FIG. 1. The pair of pivots 24 are respectively mounted on right and left side plates 30A and 30B (see FIG. 4) of the main body frame 18.

Figure 2:
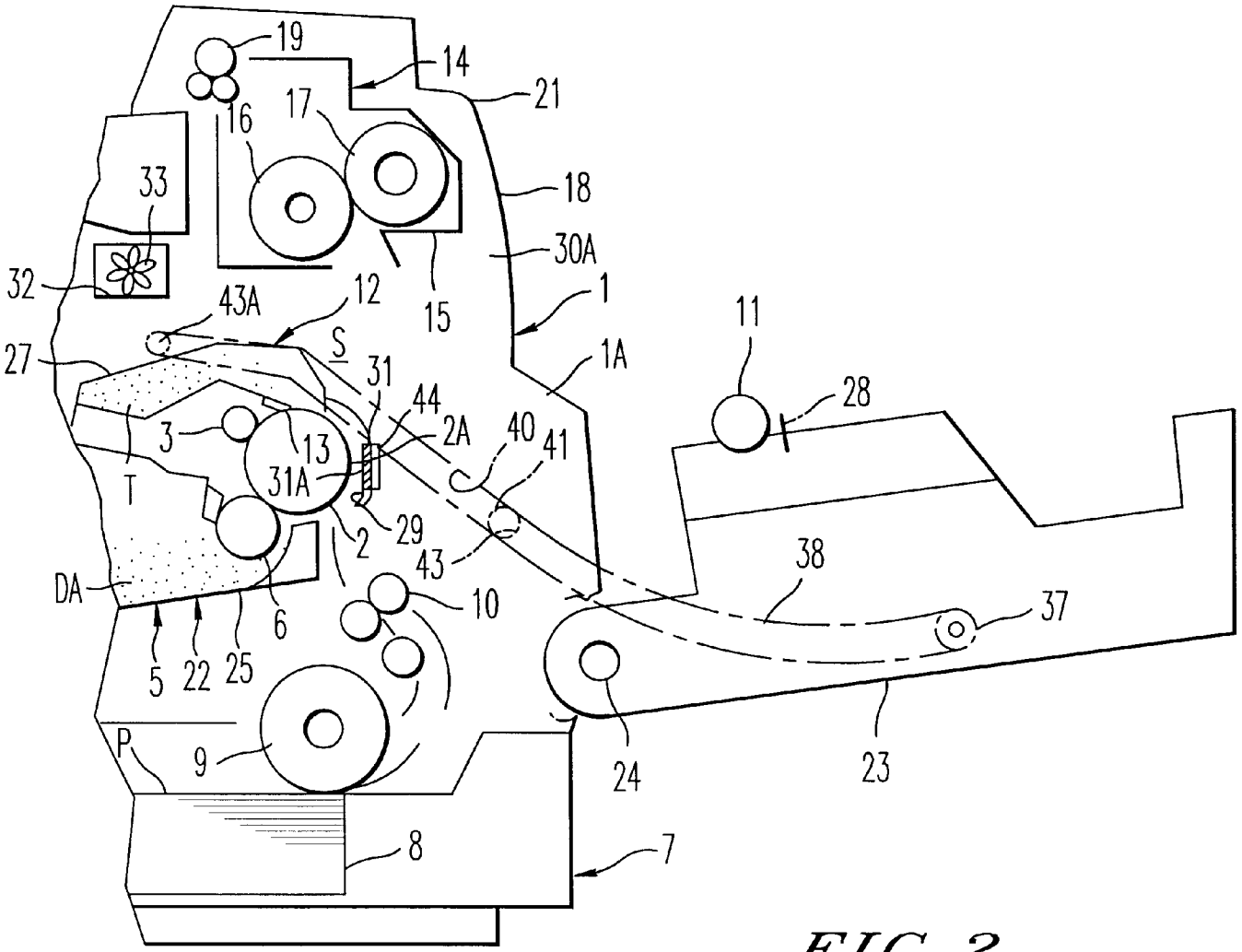
FIG. 2 is a schematic cross-sectional view illustrating an open state of an open/close member in the image forming apparatus of FIG. 1.

When the user holds and draws an upper part of the open/close member 23, the open/close member 23 rotates around the pair of pivots 24 and the conveying path between the transfer station TR and the fixing device 14 is opened, as illustrated in FIG. 2. The transfer roller 11 and the discharging needle 28 are supported on the open/close member 23, and accordingly, when the open/close member 23 is opened, both of the transfer roller 11 and the discharging needle 28 are separated from the main body of the image forming apparatus 1 as illustrated in FIG. 2.

When the conveying path between the transfer station TR and the fixing device 14 is opened as described above, a transfer sheet P jammed therein can easily be removed. Thus, the open/close member 23 is rotatably supported by the main body of the image forming apparatus 1 so that the conveying path between the transfer station TR and the fixing device 14 is opened. Further, the image forming unit 22 can be removed for replacement at a front side of the image forming apparatus 1. In the embodiment, in addition to the image forming unit 22, the sheet feeding device 7 can also be drawn from the front side (right side in FIG. 1) of the image forming apparatus 1 for replenishing the sheet feeding cassette 8 in the sheet feeding device 7 with the transfer sheets P. The sheet feeding device 7 is pushed back towards the rear side (left side in FIG. 1) of the image forming apparatus 1 after being replenished with the transfer sheets P, and is then set to the position for feeding the transfer sheets P as illustrated in FIG. 1.

When the open/close member 23 is rotated to the open position, as described above and as shown in FIG. 2, the conveying path between the transfer station TR and the fixing device 14 is exposed to the outside of the image forming apparatus 1. Because a part of the photoconductive element 2 is exposed to the outside of the unit case 25 through the opening 29 thereof, there is a possibility that the user will touch a surface of the photoconductive element 2 with their hand to damage the surface of the photoconductive element 2, or there is a possibility that the surface of the photoconductive element 2 will be deteriorated by receiving light from the outside of the image forming apparatus 1 if the photoconductive element 2 remains exposed for a long time.

Therefore, the image forming apparatus 1 is provided with a shutter unit for protecting the photoconductive element 2. The shutter unit is rotatably supported by the unit case 25 to rotate between a protecting position to cover the photoconductive element 2 exposed through the opening 29 when the open/close member 23 is opened as illustrated in FIG. 2, and a retreating position to open the part of the surface of the image bearing member 2 when the open/close member 23 is closed as illustrated in FIG. 1.

Figure 4:
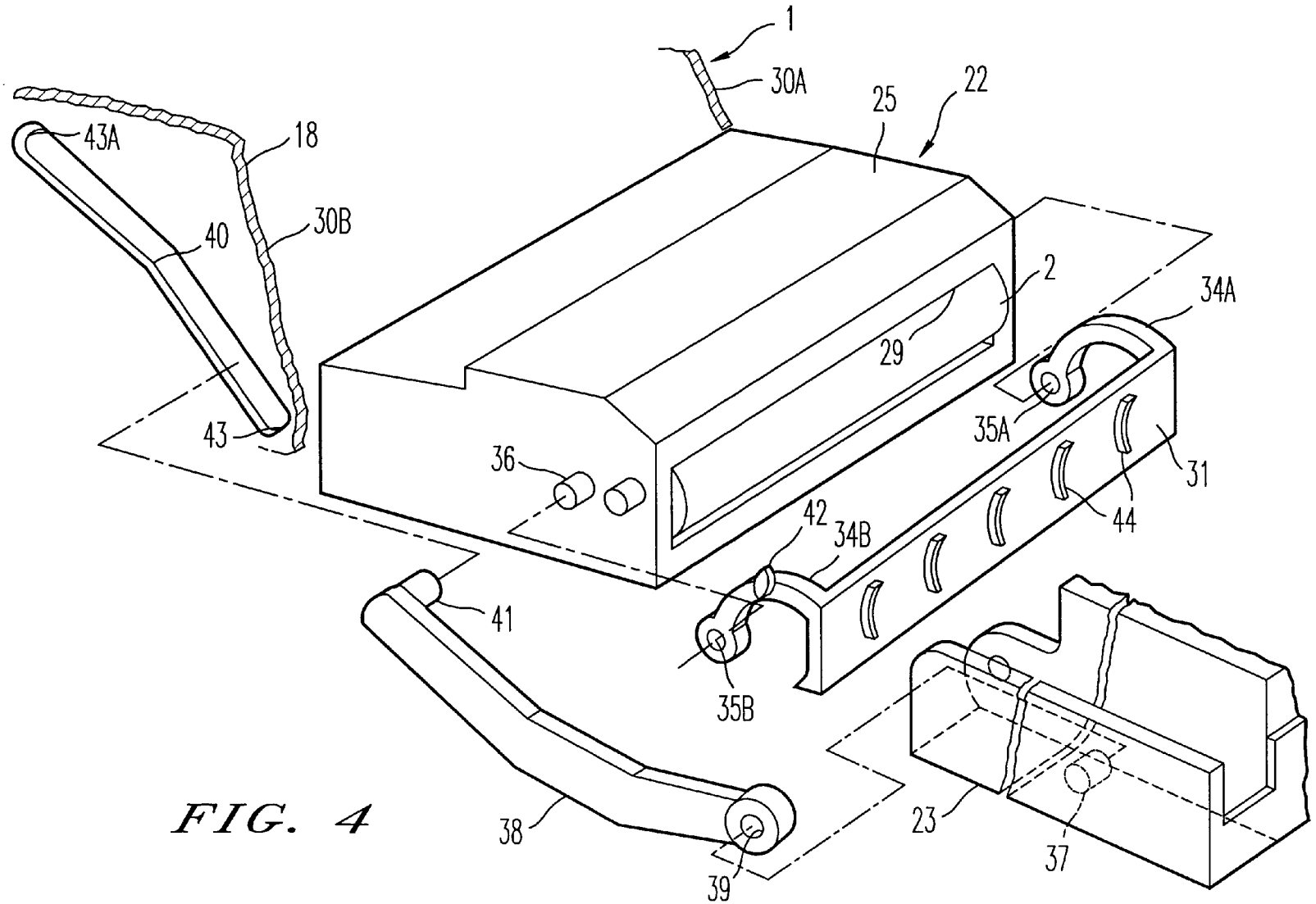
FIG. 4 is a disassembled perspective view of a main body of the image forming apparatus, an image forming unit, a shutter, an open/close member, and arms.

Next, a supporting mechanism of the shutter unit is described hereinbelow. As illustrated in FIG. 4, the shutter unit is formed of a shutter 31 and arms 34A and 34B connected to ends of the shutter 31, respectively. Fitting holes 35A and 35B are formed at respective base end portions of the arms 34A and 34B and are rotatably fitted over pivots 36 protruded from side plates of the unit case 25, respectively (FIG. 4 illustrates only one side plate). The arms 34A and 34B are arranged in parallel with each to other. The arms 34A and 34B are connected to the shutter 31 such that a flat face of the shutter 31 is substantially rectangular to a radial direction of a rotational movement of the arms 34A and 34B around the pivots 36.

In accordance with above configuration, the shutter 31 connected to the arms 34A and 34B moves between the protecting position shown in FIG. 2 and the retreating position shown in FIG. 1 in accordance with the rotation movement of the arms 34A and 34B around the pivots 36.

The shutter unit is rotatably supported on the unit case 25 that is detachably attached to the main body of the image forming apparatus 1 in this embodiment; however, the shutter unit may be directly supported by the main body of the image forming apparatus 1.

When the open/close member 23 is opened, the shutter 31 stays at the protecting position to cover the opening 29 of the unit case 25, and accordingly, the photoconductive element 2 is protected from being directly exposed to light from the outside of the image forming apparatus 1 and from being directly touched by a user's hand, as illustrated in FIG. 2.

On the other hand, when the open/close member is closed as illustrated in FIG. 1, the shutter 31 stays in a space S between the photoconductive element 2 and the fixing device 14 and is separated from the position to cover the opening 29. The photoconductive element 2 is therefore exposed to the outside of the unit case 25 through the opening 29 and the photoconductive element 2 faces the transfer roller 11, which is returned to the position to form the transfer station TR. Accordingly, the transfer sheet P is allowed to be conveyed through the transfer station TR without being blocked by the shutter 31, and thereby the image transferring operation can be smoothly performed.

Figure 3:
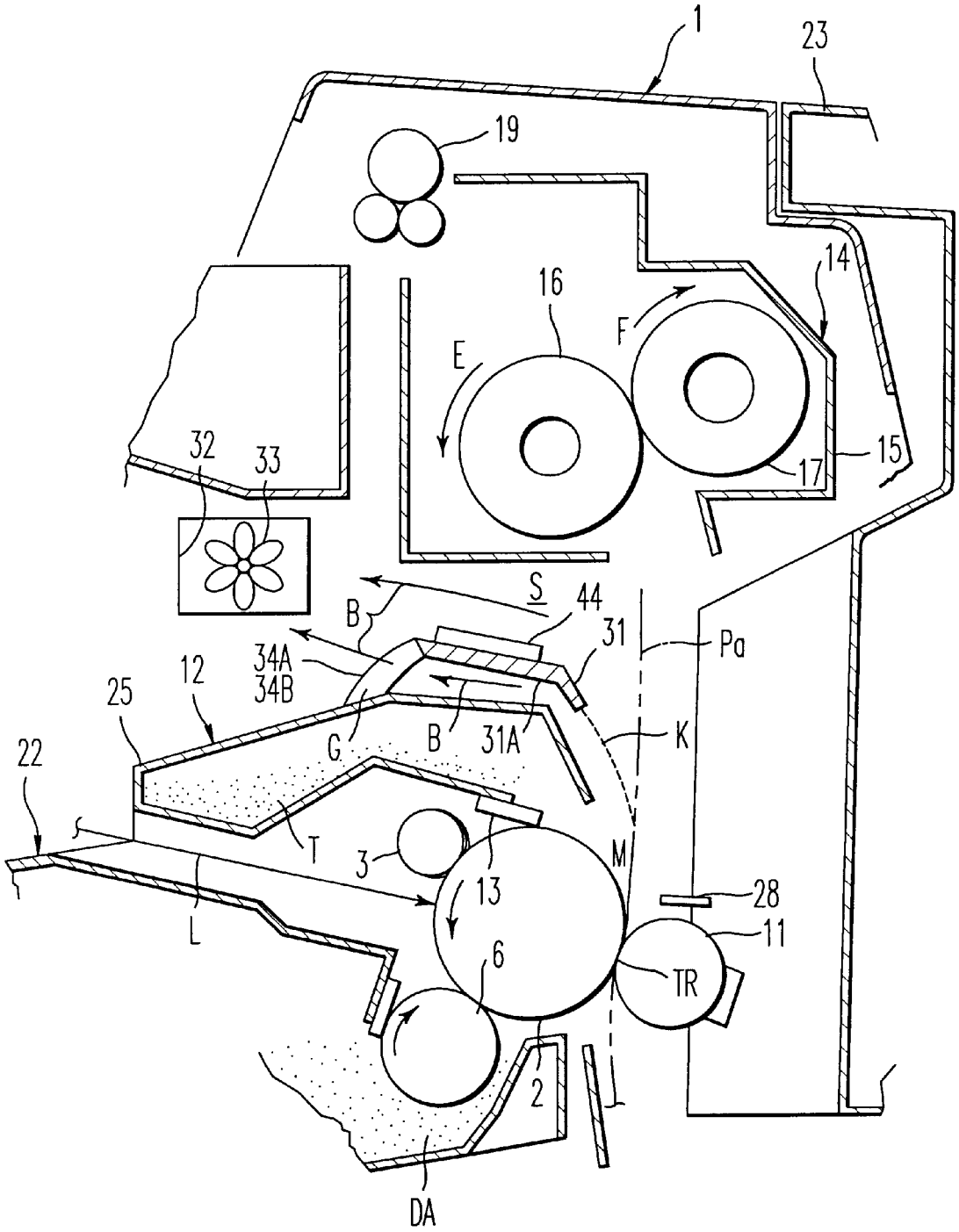
FIG. 3 is a partial enlarged illustration of the image forming apparatus of FIG. 1.

FIG. 3 is a partially enlarged illustration of the image forming apparatus 1 of FIG. 1, illustrating a state of the shutter 31 at the retreating position. The shutter unit is configured such that when the open/close member 23 is opened, the shutter 31 automatically moves from the retreating position to the protecting position for the image bearing member 2 linked with the movement of the open/close member 23. When the open/close member 23 is closed, the shutter 31 automatically moves from the protecting position to the retreating position linked with the movement of the open/close member 23, as described later.

As shown in FIG. 2, when the open/close member 23 is opened by an opening operation thereof, the shutter unit rotates to the protecting position with a face 31A of the shutter 31 facing the part of the surface 2A of the photoconductive element 2 that faces an opening 1A of the main body of the image forming apparatus 1, which is opened, as illustrated in FIG. 2. The shutter unit is rotated such that the face 31A of the shutter 31 always faces the photoconductive element 2 during a time when the shutter 31 moves between the protecting position and the retreating position or when remaining at the protecting position or the retreating position, as illustrated in FIGS. 1 to 3. The shutter unit rotates such that the face 31A of the shutter 31 moves along the exposed part of the image bearing member 2 and an outer surface of the unit case 25 covering the image bearing member 2.

Accordingly, the space occupied by the rotational movement of the shutter unit can be reduced and the size of the main body of the image forming apparatus 1 can therefore be made compact.

Figure 6:
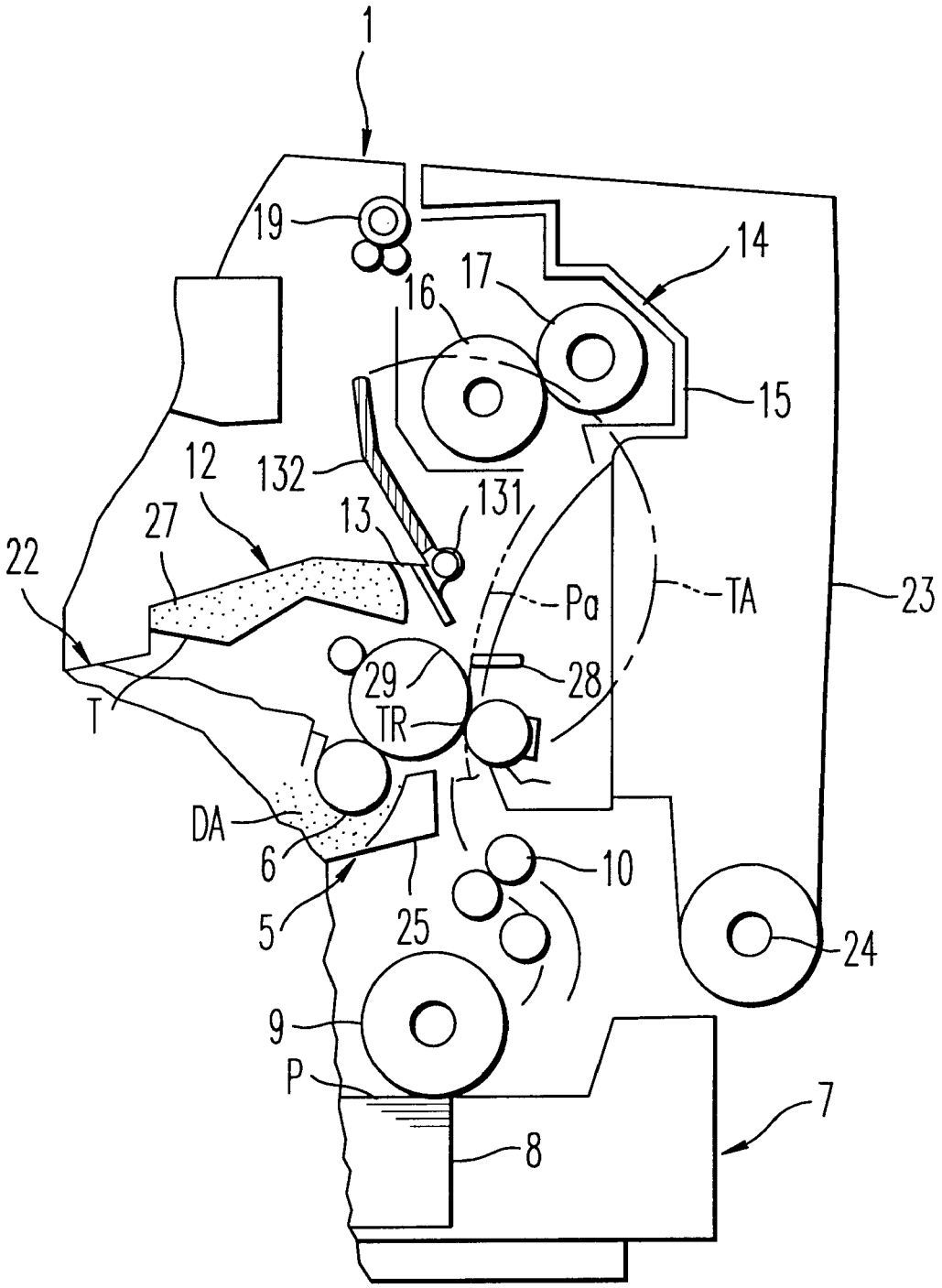
FIG. 6 BACKGROUND ART
FIG. 6 is a partial cross-sectional view illustrating an exemplary background image forming apparatus adopting a vertical conveying method of a background art.
Figure 7:
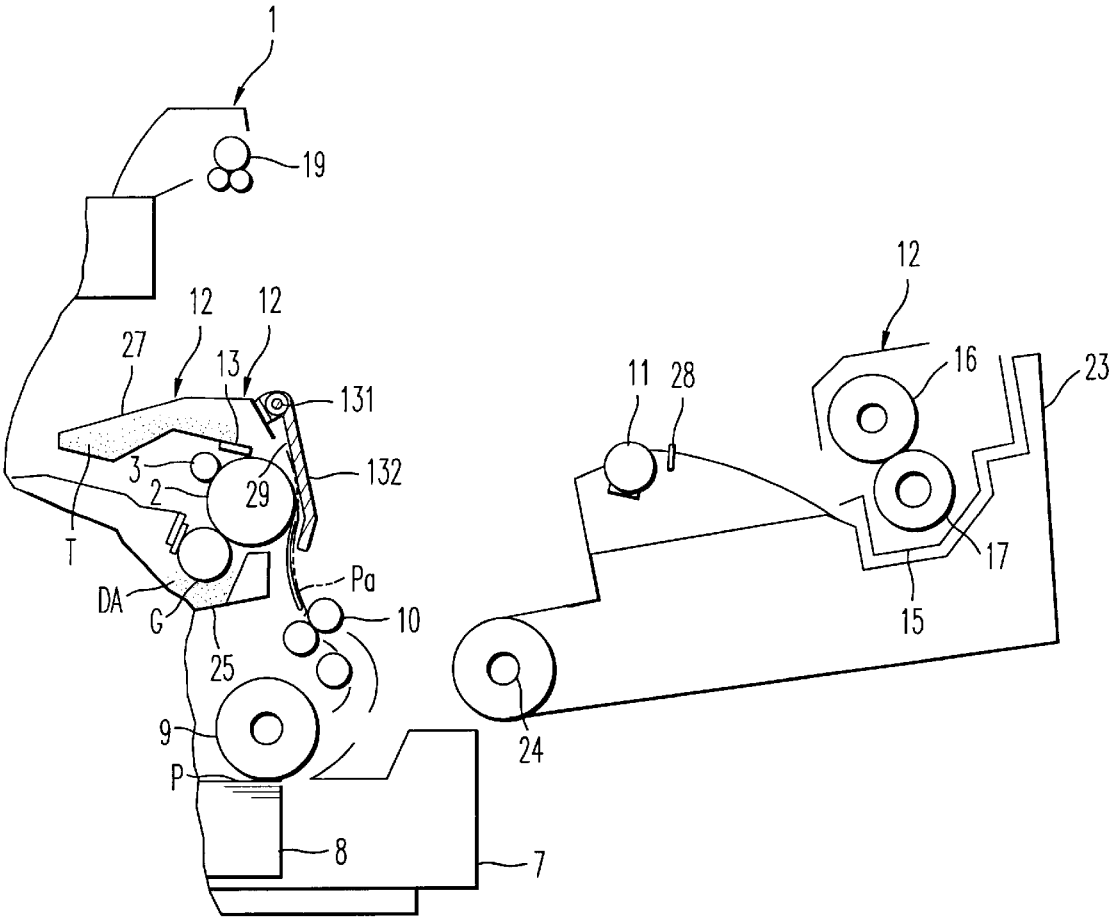
FIG. 7 is a partial cross-sectional view illustrating an open state of the open/close member in the image forming apparatus of FIG. 6.

FIGS. 6 and 7 are partial cross-sectional views illustrating a background image forming apparatus 1 including a shutter 132. In FIGS. 6 and 7 like reference numerals represent corresponding elements in FIGS. 1 to 3. FIG. 6 illustrates a closed state of the open/close member 23 in which the shutter 132 is at the retreating position. FIG. 7 illustrates an open state of the open/close member 23 in which the shutter 132 is at the protecting position for the photoconductive element 2. The shutter 132 is rotatably fixed at one end thereof to a pair of pivots 131, which are provided on the unit case 25 of the image forming unit 22 in an upper position relative to the image bearing member 2 (photoconductive element 2), as shown in FIG. 6. The shutter 132 is formed of an approximately flat configuration having a rotational axis in the same plane as that of the shutter 132 itself, as illustrated in FIGS. 6 and 7. Accordingly, when the shutter 132 rotates centered around the pair of pivots 131 between the protecting position and the retreating position, the shutter 132 rotates drawing a relatively large partial circle with the free end of the shutter as indicated by a partial circle of a dot-and-a-dash line TA in FIG. 6.

Therefore, a relatively large space is required for the shutter 132 to rotate, and accordingly the size of the main body of the image forming apparatus 1 may become relatively large.

Further, when the image forming apparatus 1 employs the vertical conveying method as illustrated in FIGS. 6 and 7, because the transfer sheet Pa being conveyed through the conveying path may flutter and may not be stable due to the force of gravity, particularly when being vertically conveyed through the conveying path between the transfer station TR and the fixing device 14, it may be desired to retreat the shutter 132 to a distant position from the conveying path between the transfer station TR and the fixing device 14 so that the shutter 132 does not interrupt the transfer sheet Pa from passing through the conveying path. In this way, as the shutter 132 in the background image forming apparatus 1 adopting the vertical conveying method is configured to rotate centered around the pair of pivots 131 located at the position illustrated in FIG. 6, the shutter 132 needs a large space to rotate as described above.

Even if the transfer sheet Pa flutters and is not stable due to the force of gravity, particularly when being vertically conveyed through the conveying path between the transfer station TR and the fixing device 14, the shutter 31 in the image forming apparatus 1 according to the above-described embodiment of the present invention illustrated in FIGS. 1 to 3 is not required to be retreated to such a long distant position from the conveying path between the transfer station TR and the fixing device 14, because the shutter unit of the present invention always rotates with a face 31A of the shutter 31 facing the photoconductive element 2 as described above. As a result, in the present invention a desired space for the rotational movement of the shutter unit can be made small.

Further, when a transfer sheet Pa is jammed in the conveying path between the transfer station TR and the fixing device 14 in the background device as illustrated in FIG. 6, the user opens the open/close member 23 to remove the jammed transfer sheet Pa, as illustrated in FIG. 7. In the background image forming apparatus 1, because the shutter 132 rotates from the retreating position illustrated in FIG. 6 to the protecting position illustrated in FIG. 7 linked with the opening operation for the open/close member 23, when the open/close member 23 is opened and thereby the shutter 132 rotates to the protecting position of FIG. 7, the shutter 132 may touch the transfer sheet Pa which is jammed in the conveying path between the transfer station TR and the fixing device 14 and then may bend the transfer sheet Pa. As a result, the shutter 132 may sandwich the transfer sheet Pa between the photoconductive element 2 and the shutter 132 as illustrated in FIG. 7. When the transfer sheet P is sandwiched, an operation for removing the transfer sheet P becomes complex and a possibility of the user touching the photoconductive element 2 with their hand increases.

On the contrary, in the image forming apparatus 1 of the present invention, when the user opens the open/close member 23 to remove a transfer sheet Pa jammed in the conveying path between the transfer station TR and the fixing device 14 as illustrated in FIG. 3, the shutter 31 thereby moves from the retreating position to the protecting position along a direction indicated by a broken line K in FIG. 3 with the movement of the open/close member 23. The shutter 31 passes through a clearance M between the transfer sheet Pa and the unit case 25 to then be positioned in the protecting position between the transfer sheet Pa and the photoconductive element 2. Accordingly, the transfer sheet Pa is not sandwiched between the shutter 31 and the photoconductive element 2. The user can therefore easily remove the jammed transfer sheet Pa with their hand without touching the surface of the photoconductive element 2.

Further, in the background image forming apparatus 1, as the shutter 132 illustrated in FIGS. 6 and 7 rotates drawing the relatively large partial circle as described above, the shutter 132 may interfere with the elements used for forming an image, such as the transfer roller 11 or the fixing device 14 of the image forming apparatus 1, and accordingly, a flexibility for disposing the elements is significantly limited. For example, when the fixing device 14 is arranged in such a position in the main body of the image forming apparatus 1 as illustrated in FIGS. 6 and 7, when the open/close member 23 is opened and the shutter 132 rotates from the retreating position to the protecting position with the opening movement of the open/close member 23, the rotating shutter 132 interferes with the fixing device 14. If the fixing device 14 is located at a further upper part of the image forming apparatus 1 at a position far separated from the transfer station TR so as to avoid interfering with the shutter 132 in FIGS. 6 and 7, the size of the image forming apparatus 1 may become relatively large. Therefore, the fixing device 14 in the background image forming apparatus 1 is not supported on the main body of the image forming apparatus 1 but instead is supported on the open/close member 23 so that when the open/close member 23 is opened, the fixing device 14 is separated from the main body to a position which does not interfere with the shutter 132. However, when the fixing device 14 is supported on the open/close member 23 as described above, while the photoconductive element 2 is supported on the main body of the image forming apparatus 1, it becomes difficult to secure a relative positional accuracy including a parallelism between the fixing device 14 and the photoconductive element 2.

Consequently, in the background image forming apparatus each of the rotational shafts of the fixing roller 16 and the pressure roller 17 included in the fixing device 14 may not be located in accurate parallelism with the photoconductive element 2, resulting in a corrugation of the transfer sheet Pa which may cause a sheet jamming at the fixing device 14. In order to secure the relative positional accuracy, the open/close member 23 may be required to have a rigid structure resulting in high production costs.

On the other hand, in the image forming apparatus 1 of the present invention illustrated in FIGS. 1 to 3, the fixing device 14 is not supported on the open/close member 23 but instead is supported on the main body of the image forming apparatus 1. Further, the distance between the transfer station TR and the fixing device 14 is made relatively short. Moreover, because the shutter unit rotates such that the shutter 31 moves along the outer surface of the unit case 25, there is no possibility of interference between the shutter 31 and the fixing device 14. Furthermore, the relative positional accuracy between the fixing device 14 and the photoconductive element 2 can be easily maintained because the fixing device 14 is supported by the main body of the image forming apparatus 1.

In the background image forming apparatus 1 illustrated in FIG. 6, when an image forming operation is performed by the image forming apparatus 1, if a large amount of heat is radiated from the fixing device 14 and the heat is transmitted to the photoconductive element 2 and other image forming elements, the photoconductive element 2 and other image forming elements may deteriorate. In addition, when a toner powder contained in the developer container of the developing apparatus 5 receives the heat, a resin component of the toner powder may melt by the heat and then aggregate resulting in causing a toner blocking. As a result, quality of the toner image may be significantly deteriorated and the cleaning case 27 may not contain the predetermined amount of the remaining toner T because the aggregated toner cannot smoothly enter the inlet of the cleaning case 27.

In the image forming apparatus 1 in the present invention illustrated in FIGS. 1 to 3, when the image forming operation is performed with the shutter 31 at the retreating position, because the shutter 31 is positioned in the space S between the photoconductive element 2 and the fixing device 14 as mentioned above, the heat radiated from the fixing device 14 is interrupted by the shutter 31. Therefore, a large amount of heat does not reach each of image forming elements, such as the photoconductive element 2, the cleaning device 12, and the developing apparatus 5, and accordingly the deterioration of each of the image forming elements and the occurrence of the toner blocking can be prevented.

However, when the image forming operation is performed for a long time, because the shutter 31 is heated at a relatively high temperature by the heat radiated by the fixing device 14, the heat may eventually be transmitted to the photoconductive element 2 and other image forming elements, such as the cleaning device 12, and the developing apparatus 5. Accordingly, as illustrated in FIG. 1, a fan 33 may be provided for discharging air in the main body of the image forming apparatus 1 outwards through a discharging outlet 32 formed on the main body of the image forming apparatus 1. An airflow is generated by an operation of the fan 33 so that the air passes by the shutter 31 remaining at the retreating position. Specifically, the air in the main body of the image forming apparatus 1 is circulated by the operation of the fan 33 such that the air around the shutter 31 at the retreating position flows in the direction indicated by an arrow B in FIG. 3. The shutter 31 is thus cooled with the airflow and is prevented from being heated to a relatively high temperature.

Further, in the image forming apparatus 1 of the present invention, the cleaning device 12 is located at an upper part of the image forming apparatus 1 relative to the image bearing member 2. When the shutter 31 is at the retreating position, as illustrated in FIG. 3, the shutter 31 is positioned in the space S between the cleaning device 12 and the fixing device 14. The face 31A of the shutter 31 is positioned facing an upper surface of the cleaning device 12 and is positioned approximately in parallel with the upper surface of the cleaning device 12. In addition, the shutter 31 is positioned separated from the upper surface of the cleaning device 12 when the shutter 31 is at the retreating position, such that the air can flow through an air gap between the shutter 31 and the cleaning device 12.

With the above-described configuration in the present invention, the air smoothly flows through the air gap formed above and below the shutter 31, in which the most part of the air flows in one direction, and the shutter 31 is therefore effectively cooled. The shutter 31 may also be made hollow to insulate the heat, or an insulation may be provided in the hollow to increase an insulating effect of the shutter 31, such that the transmission of the heat to the image forming unit 22 from the fixing device 14 can be further effectively prevented. However, when the shutter 31 at the retreating position is configured to be positioned in the passageway of the airflow caused by the fan 33 as described above, the transmission of the heat to the image forming unit 22 from the fixing device 14 can effectively be prevented even if the shutter 31 is not made hollow or insulation is not provided inside the hollow shutter 31. Therefore, the production cost of the shutter unit is decreased and the size of the shutter unit can be made relatively small.

As illustrated in FIGS. 1 to 4, the shutter 31 may be provided with a plurality of ribs 44 projected on an outer surface, that is, an opposite side of the face 31A of the shutter 31. As a result, when the shutter 31 is at the retreating position illustrated in FIGS. 1 and 3, the airflow that flows along the outer surface of the shutter 31 is guided towards the fan 33 by the ribs 44. Because of the ribs 44, the air flows further smoothly along the surface of the shutter 31 towards the fan 33 and the shutter 31 can be further effectively cooled. In an example illustrated in FIG. 1, the discharging outlet 32 is formed on the side plate 30A of the main body frame 18 and the fan 33 is mounted on a portion of the discharging outlet 32. In FIG. 4, the fan 33 is located at the right side of the main body when viewed from the front of the apparatus. The ribs 44 are therefore inclined to the direction towards the fan 33, i.e., forward right in FIG. 4, so that the air is smoothly led to the fan 33. The ribs 44 form an example of an air guide device to guide the air towards the fan 33.

Further, as apparent from FIGS. 1, 3, and 4, the connected end portions of the arms 34A and 34B are positioned at the further upper part of the image forming apparatus 1 relative to the upper surface of the cleaning device 12 so that the air flows through the air gap G (see FIG. 3) between the arms 34A and 34B illustrated in FIG. 4 when the shutter 31 remains at the retreating position. Accordingly, when the shutter 31 remains at the retreating position, the air can certainly be flowed through the air gap between the shutter 31 and the cleaning device 12.

Furthermore, because the shutter unit is rotatably and directly supported on the unit case 25 of the image forming unit 2 via the arms 34A and 34B, the shutter 31 more certainly closes or opens the opening 29. That is, if the shutter 31 is supported on a position other than the unit case 25, a positional accuracy between the shutter 31 and the opening 29 may fluctuate due to the fluctuation of the positional relationship between the shutter 31 and the unit case 25. Moreover, the shutter unit may be assembled with the image forming unit 22 to further form another unit. Therefore, the image forming unit 22 and the shutter 31 can easily be handled when a maintenance for the image forming unit 22, a replacement of the parts in the unit 22, or the like, is performed.

Further, in the image forming apparatus 1 of the present invention, because the shutter 31 at the retreating position is located between the fixing device 14 and the unit case 25 as described above, the transmission of heat from the fixing unit 14 to the image forming unit 22 is effectively prevented without mounting an insulation on the outer surface of the unit case 25 which faces the fixing device 14, which otherwise may become necessary to prevent the transmission of heat from the fixing device 14 to the image forming unit 22. The production costs of the image forming unit 22 are decreased by thus eliminating the insulation on the unit case 25.

The image forming unit 22 is a consumable component which is removed for replacement when the toner in the developing apparatus 5 has run out, the cleaning device 12 is filled up with the remaining toner T reclaimed from the surface of the photoconductive element 2, or the photoconductive element 2 has deteriorated. If the production costs of the image forming unit 22 increase, the user is burdened by a relatively large economic load for replacement of the image forming unit 22. However, in the image forming apparatus 1 of the present invention, the image forming unit 22 is not provided with the insulation, and thus such a disadvantage as mentioned above is dissolved.

Further, in the image forming apparatus 1 of the present invention, a linking device is provided to operate the shutter 31 linked with a movement of the open/close member 23 such that when the open/close member 23 moves from the open position to the closed position, the shutter 31 simultaneously moves from the protecting position to the retreating position and vice versa. Namely, the shutter 31 is automatically operated to move between the retreating position and the protecting position with the open/close operation of the open/close member 23. An example of the linking device is described below.

As illustrated in FIG. 4, a pivot 37 is projected on the open/close member 23, and a boss 39 formed at one side end portion of a long extended arm 38 is rotatably fitted over the pivot 37. A long extended guide slot 40 is formed on the side plate 30 of the main body frame 18 and a cylindrically shaped guide pin 41, which is projected on another side end of the long extended arm 38, slidably fits into the guide slot 40. In FIGS. 1 and 2, the location of the long extended arm 38 and the guide slot 40 is illustrated by a dot-and-a-dash line.

On the other hand, a projecting portion 42 is formed at approximately the middle between the connected end portion and the base end portion of the arm 34 of the shutter unit.

Figure 5:
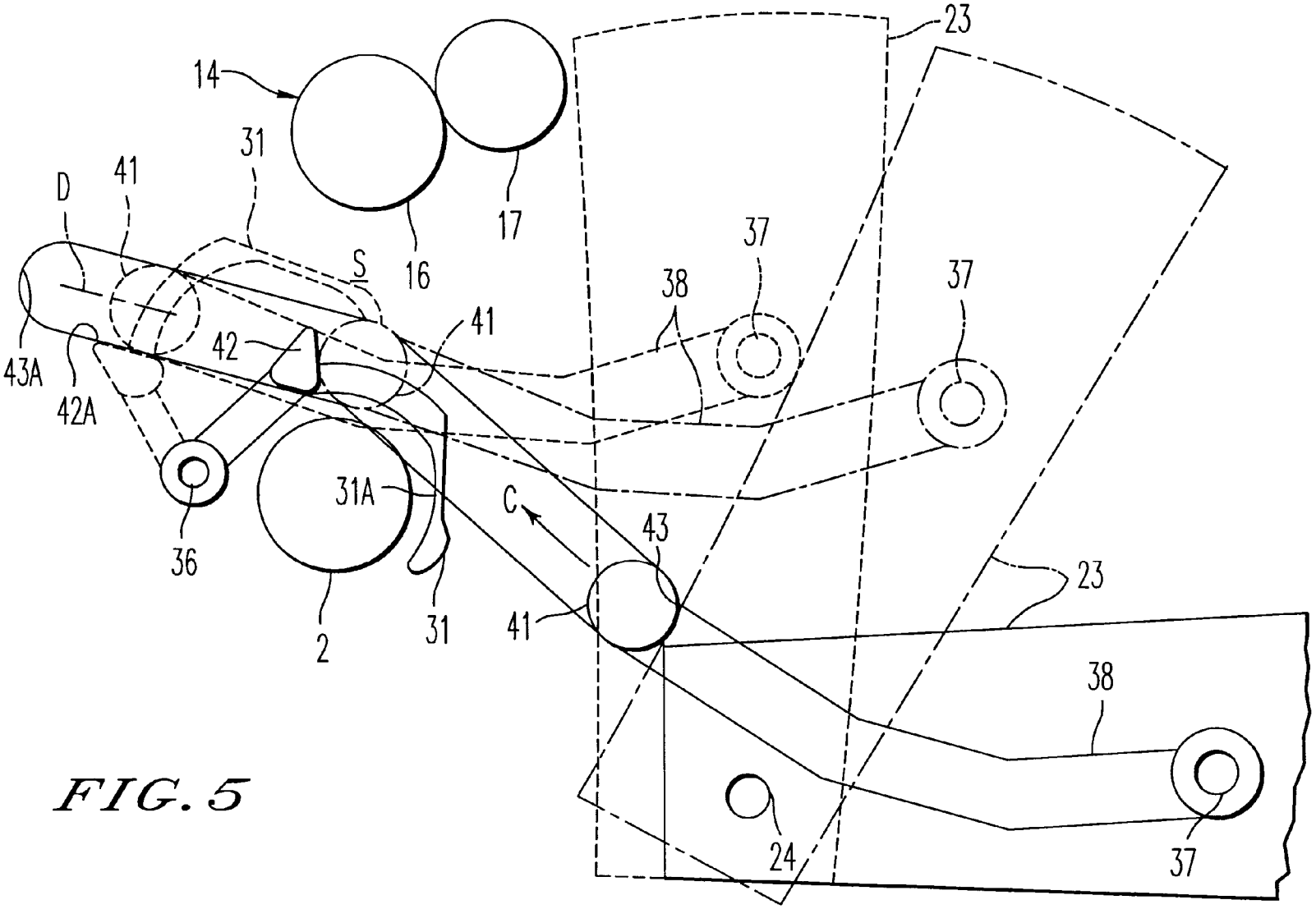
FIG. 5 is an explanatory view illustrating an operation of a shutter linked with an open/close operation of an open/close member.

FIG. 5 is an explanatory view illustrating an open/close operation of the open/close member 23 and a state of the shutter unit to be operated linked with the open/close operation of the open/close member 23. When the open/close member 23 is at an open position illustrated in FIG. 5 by a solid line, the long extended arm 38 is at a position indicated by the solid line. At the same time, the guide pin 41 projected on the long extended arm 38 contacts an end portion 43 of the guide slot 40 at the side near the open/close member 23. In the above-mentioned state, the shutter 31 is at the protecting position indicated by a solid line in FIG. 5 to cover the photoconductive element 2. The shutter 31 is given a bias via the arms 34A and/or 34B towards the protecting position to cover the photoconductive element 2 by a biasing device (not shown), such as, for example, a twisting coil spring which is wound centered around at least one of the pair of pivots 36 protruding from the side plates of the unit case 25, and is kept at the protecting position.

When the open/close member 23 is started to be closed and to rotate centered around the pair of pivots 24 provided at a lower part of the open/close member 23, the long extended arm 38 moves according to the rotation of the open/close member 23 as mentioned above and the guide pin 41 moves in a direction indicated by an arrow C being guided by the guide slot 40 in a sliding manner, as illustrated in FIG. 5. When the open/close member 23 rotates to a position indicated by a dot-and-a-dash line in FIG. 5, the long extended arm 38 also moves to a position indicated by a dot-and-a-dash line at the same time and the guide pin 41 projected on the long extended arm 38 contacts the projecting portion 42 on the arm 34 of the shutter unit. When the open/close member 23 continuously rotates to close, the guide pin 41 starts to push the projecting portion 42. In accordance with the operation as mentioned above, the shutter 31 starts to move towards the retreating position.

When the open/close member 23 reaches the closed position indicated by a broken line in FIG. 5, the long extended arm 38 also reaches a position indicated by a broken line in FIG. 5 and the shutter 31 reaches the retreating position indicated by a broken line in FIG. 5. When the shutter 31 is at the retreating position, because the guide pin 41 is kept at a state of pressing the projecting portion 42 on the arm 34 of the shutter unit, the open/close member 23 is kept at the closed position against a repulsion of the aforementioned biasing device. The projecting portion 42 is provided to the arm 34 of the shutter unit such that a flat-face portion 42A of the projecting portion 42 is in parallel with an extending direction of the guide slot 40, namely, in parallel with a direction of a dot-and-a-dash arrow D in FIG. 5 when the shutter 31 is at the retreating position.

With this structure, even if the mounting position of the guide pin 41 on the long extended arm 38 fluctuates in a direction indicated by an arrow C in FIG. 5, relative to that of the projecting portion 42, the shutter 31 always returns at the same retreating position. As far as the guide pin 41 moves in the direction of the dot-and-a-dash line D, which is not a rotating direction of the arm 34, after the flat-face portion 42A of the projecting portion 42 reaches the position in parallel with the extending direction of the guide slot 40, the arm 34 is not given a rotation torque from the guide pin 41 to move the shutter 31. Consequently, the shutter 31 can remain at an accurate retreating position, even if the position of the pivot 37 on the open/close member 23, over which the boss 39 formed on one side end of the long extended arm 38 is fit, is fluctuated and is located somewhat inaccurately.

Accordingly, the shutter 31 is prevented from protruding into the conveying path between the transfer station TR and the fixing device 14, and thus the transfer sheet Pa is prevented from being interrupted by the shutter 31.

Further, the guide slot 40 is formed relatively long so that the other end portion 43A of the guide slot 40 and the guide pin 41 are separated from each other even when the open/close member 23 reaches the closed position. Therefore, the open/close member 23 is certainly rotated to the closed position and the shutter 31 is accurately kept at the retreating position even if the position of the pivot 37 is not accurately positioned relative to that of the open/close member 23.

When the open/close member 23 is closed, the open/close member 23 is kept at the closed position by a locking device (not shown). When the locking device is released for opening the open/close member 23, the shutter 31 moves to the protecting position by a resilient bias of the biasing device as mentioned above.

As described above, in the image forming apparatus 1 of the present invention, the linking device to operate the shutter unit linked with a movement of the open/close member 23 includes such elements as the long extended arm 38 on one side end of which the boss 39 is formed to fit over the pivot 37 on the open/close member 23, the guide slot 40 formed on the side plate 30 of the main body frame 18 into which the guide pin 41 is fit, the projecting portion 42 provided at approximately the middle between the connected end portion and the base end portion of the arm 34 of the shutter unit, and the biasing device to give the resilient bias to the shutter unit towards the protecting position.

The present invention can also be applied to various other image forming apparatuses such as an electrophotographic copying machine, a facsimile machine, a multifunctional machine, and the like, other than that illustrated in FIG. 1. In addition, the present invention can be applied to an image forming apparatus including an image bearing member which is formed of an intermediate transfer belt onto which a toner image is transferred from a photoconductive element.

Numerous additional modifications and variations of the present invention are possible in light of the above teachings. It is therefore to be understood that within the scope of the appended claims, the present invention may be practiced otherwise than as specifically described herein.

This document is based on Japanese patent applications JPAP10-096717 filed in the Japanese Patent Office on Mar. 25, 1998, and JPAP10-331986 filed in the Japanese Patent Office on Nov. 6, 1998, and the entire contents of which are hereby incorporated by reference.

What is claimed is:

1. An image forming apparatus, comprising:

an image bearing member configured to form a toner image thereupon;

a transfer device positioned adjacent to said image bearing member and configured to transfer said toner image formed on a surface of said image bearing member onto a surface of a recording medium;

a fixing device provided in an upper part of the image forming apparatus and configured to fix said toner image transferred onto said surface of said recording medium when said recording medium passes through said fixing device;

an open/close member rotatably supported by a main body of the image forming apparatus and configured to open and close a recording medium conveying path between said transfer device and said fixing device; and a shutter movably supported and configured to move, through a linking mechanism connecting said shutter to said open/close member, between a protecting position to cover a part of said surface of said image bearing member facing an outside of the image forming apparatus when said open/close member is opened and a retreating position to open said part of said surface of said image bearing member when said open/close member is closed, wherein said retreating position of said shutter is set in a space between said image bearing member and said fixing device, and wherein said shutter is rotatably supported by the main body of the image forming apparatus such that said shutter moves with a first face of said shutter continuously directed toward said image bearing member when said shutter moves between said protecting position and said retreating position.

2. An image forming apparatus according to claim 1, wherein said fixing device is supported on a side of the main body of the image forming apparatus.

3. An image forming apparatus according to claim 1, further comprising a cleaning device configured to clean said surface of said image bearing member by removing remaining toner on said surface of said image bearing member after said toner image has been transferred onto said recording medium.

4. An image forming apparatus according to claim 3, further comprising a fan provided in the main body of the image forming apparatus to discharge air inside the main body outwards from the main body, and wherein said fixing device is configured to fix said toner image transferred onto said recording medium by application of heat upon the toner image, and wherein a position of said fan is set so that an airflow generated by said fan passes said shutter at said retreating position.

5. An image forming apparatus according to claim 4, wherein said cleaning device is disposed at an upper part of the image forming apparatus relative to said image bearing member, and said retreating position of said shutter is set so that when said shutter is in said retreating position, said shutter is located in a space between said cleaning device and said fixing device and said face of said shutter that faces the image bearing member when the shutter is in the protecting position is positioned facing an upper surface of said cleaning device.

6. An image forming apparatus according to claim 5, wherein when said shutter is in said retreating position, said shutter is positioned separated from said upper surface of said cleaning device so that the airflow passes through an air gap between said shutter and said cleaning device.

7. An image forming apparatus according to claim 6, wherein first ends of a pair of arms are respectively connected to said shutter at longitudinal ends thereof in a body, and second ends of said pair of arms are rotatably supported by the main body of the image forming apparatus, and when said shutter is in said retreating position, the first ends of said arms are upwardly positioned above said upper surface of said cleaning device so that air flows through an air gap between said pair of arms.

8. An image forming apparatus according to claim 4, further comprising a plurality of ribs formed on a second face of the shutter and configured to control the airflow generated by said fan.

9. An image forming apparatus, comprising:

image bearing means for forming a toner image thereupon;

transfer means positioned adjacent to said image bearing means for transferring said toner image formed on a surface of said image bearing means onto a surface of a recording medium;

fixing means provided in an upper part of the image forming apparatus for fixing said toner image transferred onto said surface of said recording medium when said recording medium passes through said fixing means;

open/close means rotatably supported by a main body of the image forming apparatus for opening and closing a recording medium conveying path means between said transfer means and said fixing means; and shutter means movably supported to move, through a linking means connecting said shutter means to said open/close means, between a protecting position for covering a part of said surface of said image bearing means facing an outside of the image forming apparatus when said open/close means is opened and a retreating position for opening said part of said surface of said image bearing means when said open/close means is closed, wherein said retreating position of said shutter means is set in a space between said image bearing means and said fixing means and wherein said shutter means is rotatably supported by the main body of the image forming apparatus such that said shutter means moves with a first face of said shutter means continuously directed toward said image bearing means when said shutter means moves between said protecting position and said retreating position.

10. The image forming apparatus according to claim 9, wherein said fixing means is supported on a side of the main body of the image forming apparatus.

11. An image forming apparatus according to claim 9, further comprising cleaning means for cleaning said surface of said image bearing means by removing remaining toner on said surface of said image bearing means after said toner image has been transferred onto said recording medium.

12. An image forming apparatus according to claim 11, further comprising fan means in the main body of the image forming apparatus for discharging air inside the main body outwards from the main body, and wherein said fixing means fixes said toner image transferred onto said recording medium by application of heat upon the toner image, and wherein a position of said fan means is set so that an airflow generated by said fan means passes said shutter means at said retreating position.

13. An image forming apparatus according to claim 12, wherein said cleaning means is disposed at an upper part of the image forming apparatus relative to said image bearing means, and said retreating position of said shutter means is set so that when said shutter means is in said retreating position, said shutter means is located in a space between said cleaning means and said fixing means and said face of said shutter means that faces the image bearing means when the shutter means is in the protecting position is positioned facing an upper surface of said cleaning means.

14. The image forming apparatus according to claim 13, wherein when said shutter means is in said retreating position, said shutter means is positioned separated from said upper surface of said cleaning means so that the airflow passes through an air gap between said shutter means and said cleaning means.

15. The image forming apparatus according to claim 14, further comprising first ends of a pair of arm means respectively connected to said shutter means at longitudinal ends thereof in a body, and second ends of said pair of arm means rotatably supported by the main body of the image forming apparatus, and wherein when said shutter means is in said retreating position, the first ends of said arm means are upwardly positioned above said upper surface of said cleaning means so that air flows through an air gap between said pair of arm means.

16. An image forming apparatus according to claim 13, further comprising rib means on a second face of the shutter means for controlling an airflow generated by the fan means.

* * * * *